US011559095B2

(12) United States Patent
Rieland

(10) Patent No.: US 11,559,095 B2
(45) Date of Patent: Jan. 24, 2023

(54) BODY PAD FOR SUPPORT APPARATUS

(71) Applicant: Sumner P. Rieland, Seattle, WA (US)

(72) Inventor: Sumner P. Rieland, Seattle, WA (US)

( * ) Notice: Subject to any disclaimer, the term of this patent is extended or adjusted under 35 U.S.C. 154(b) by 101 days.

(21) Appl. No.: 16/726,842

(22) Filed: Dec. 25, 2019

(65) Prior Publication Data

US 2021/0195966 A1 Jul. 1, 2021
US 2022/0079256 A9 Mar. 17, 2022

Related U.S. Application Data

(60) Provisional application No. 62/784,639, filed on Dec. 24, 2018.

(51) Int. Cl.
*A41F 9/02* (2006.01)
*A41D 13/00* (2006.01)
*A63B 21/00* (2006.01)

(52) U.S. Cl.
CPC ..... *A41F 9/02* (2013.01); *A41D 13/0007* (2013.01); *A63B 21/4001* (2015.10)

(58) Field of Classification Search
CPC . A41D 9/00; A41D 9/002; A41D 9/02; A41D 9/025; A41D 13/0007; A41D 13/0525; A63B 21/4001; A61F 5/028
USPC ..... 2/311, 321
See application file for complete search history.

(56) References Cited

U.S. PATENT DOCUMENTS 2,590,616 A 3/1952 Heller
3,921,222 A 11/1975 Hollman
4,452,161 A 6/1984 McCoy
4,685,668 A 8/1987 Newlin, Jr.
4,761,834 A 8/1988 Kolb
4,964,401 A 10/1990 Taigen
5,168,577 A * 12/1992 Detty ..... A41D 13/065 2/24
5,337,417 A 8/1994 Whiteside
5,500,952 A 3/1996 Keyes
5,518,009 A * 5/1996 Ruiz-Gonzalez ..... A61F 5/028 128/869
5,758,366 A * 6/1998 Wilson ..... A41F 9/02 2/311
5,782,782 A 7/1998 Miller
5,948,707 A * 9/1999 Crawley ..... B32B 27/12 442/101
7,992,506 B1 8/2011 Patton
8,376,808 B2 2/2013 Hopkins
8,695,115 B2 4/2014 Leyva
(Continued)

FOREIGN PATENT DOCUMENTS

WO WO-2012138569 A1 * 10/2012 ..... A41D 13/0015

OTHER PUBLICATIONS

2013 Prolimit Kitewaist Pro Harness Review. The Kiteboarder. Jun. 26, 2013.
2014 Buyer's Guide: Ion. The Kiteboarder. Nov. 19, 2013.

*Primary Examiner* — Jocelyn Bravo

(57) ABSTRACT

A body pad apparatus with high surface friction on the inward-facing and outward-facing surfaces, to prevent slipping or repositioning of a body harnesses or personal flotation device, made of a material of a desired thickness that that conforms to stretch and pressure, and that has low profile attachments to secure the pad apparatus on, around, or to the user's body or to the harness or personal flotation device.

11 Claims, 5 Drawing Sheets

(56) References Cited

U.S. PATENT DOCUMENTS

| | | | | |
|---|---|---|---|---|
| 2002/0087105 | A1* | 7/2002 | Grosso | A61F 5/028 602/13 |
| 2003/0125650 | A1* | 7/2003 | Grosso | A61F 5/34 602/19 |
| 2004/0003454 | A1* | 1/2004 | Morrow | A63B 71/12 2/455 |
| 2006/0046589 | A1 | 3/2006 | Farley | |
| 2010/0319097 | A1* | 12/2010 | Turner | A41D 13/05 2/22 |
| 2012/0137401 | A1* | 6/2012 | Ramirez | A41D 19/0017 2/161.1 |
| 2014/0173816 | A1 | 6/2014 | Grady | |
| 2016/0066679 | A1* | 3/2016 | Capps | A45F 3/005 224/660 |
| 2016/0135528 | A1* | 5/2016 | Baschak | A41F 9/00 2/244 |
| 2016/0221649 | A1 | 8/2016 | Harrington | |
| 2017/0295870 | A1* | 10/2017 | Harris | A41C 3/0057 |
| 2019/0343205 | A1* | 11/2019 | Clausen | A61H 23/02 |

* cited by examiner

BODY PAD FOR SUPPORT APPARATUS

CROSS-REFERENCE TO RELATED APPLICATIONS

The present application claims priority to provisional patent application No. 62/784,639 filed on Dec. 24, 2018, disclosures of which is incorporated herein at least by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention is in the field of wearable support apparatus. The present invention pertains more particularly to apparatus for use with sports and safety equipment.

2. Description of Related Art

Externally worn apparatus, such as harnesses used for kiteboarding and windsurfing, some safety harnesses and personal flotation devices (commonly known as PFDs), tend to move and shift from their desired preset position on the user's body, when in use, or from poor initial fit, and become uncomfortable and/or less effective as they shift from their desired preset position. Movement in the harness or personal flotation device can exacerbate preexisting gaps and pressure points between the user's body and the harness or personal flotation device. Some personal flotation devices, commonly known as "life jackets", or vest style personal floatation devices, can be especially poorly fitting for some users.

There exist slip preventative waistbands for common pants, trousers, and clothing. These similar devices, used for garment slip limitation, incorporate extraneous parts, or are not contoured to fit the user's body, or are not designed of a material or thickness for use with external sports apparatus such as body harnesses and Personal Floatation Devices.

In unrelated fields, there are slimming belts that stretch to fit around the waist for the purpose of losing weight through heat retention or appearing thinner through mechanical constriction of the body. These devices appear similar in appearance to the present invention but are not designed in a way to limit movement of an externally worn body harness or personal flotation device. These similar weight loss and slimming devices do not use textured material on both sides.

There exists apparatus worn around the body for impact protection using padding. These impact protection devices do not use surface friction material on both inward-facing and outward-facing surfaces for the purpose of limiting slip of apparatus worn over them.

Therefore, what is clearly needed is a wearable apparatus that limits movement of, and pads pressure points or fills gaps between a user's body and a body harness, or personal flotation device, and to provide a better fit for the user of externally worn body harnesses and personal flotation devices.

BRIEF SUMMARY OF THE INVENTION

The present invention provides a solution to unwanted movement, poor fit, and/or discomfort of body harnesses, and personal floatation devices. The present invention uses material surface friction to limit slip of the harness or personal floatation device. The present invention uses material stretch and padding to conform to pressure points and gaps between the user's body and the harness or personal flotation device. The present invention uses low profile attachments to secure the user on or around the user or to an external apparatus worn by the user.

DETAILED DESCRIPTION OF THE INVENTION

The inventor provides a body pad apparatus to limit slip, to limit movement, to pad pressure points, and to fill spaces of and between the user's body and an externally worn apparatus such as a sports harness used in kiteboarding or windsurfing, such as climbing or safety harnesses, or such as personal flotation devices used in water sports. Components of a harness or personal flotation device for which the present invention may be applied may include, but are not limited to, surfaces, belts, plates, straps, pads, buckles, and fasteners. The present invention could ideally be worn around the waist, torso, or leg, in between the user's body and an external apparatus. The present invention is described in enabling detail in the following examples, which may represent more than one embodiment of the present invention.

Figures 1A, 1B, 1C:
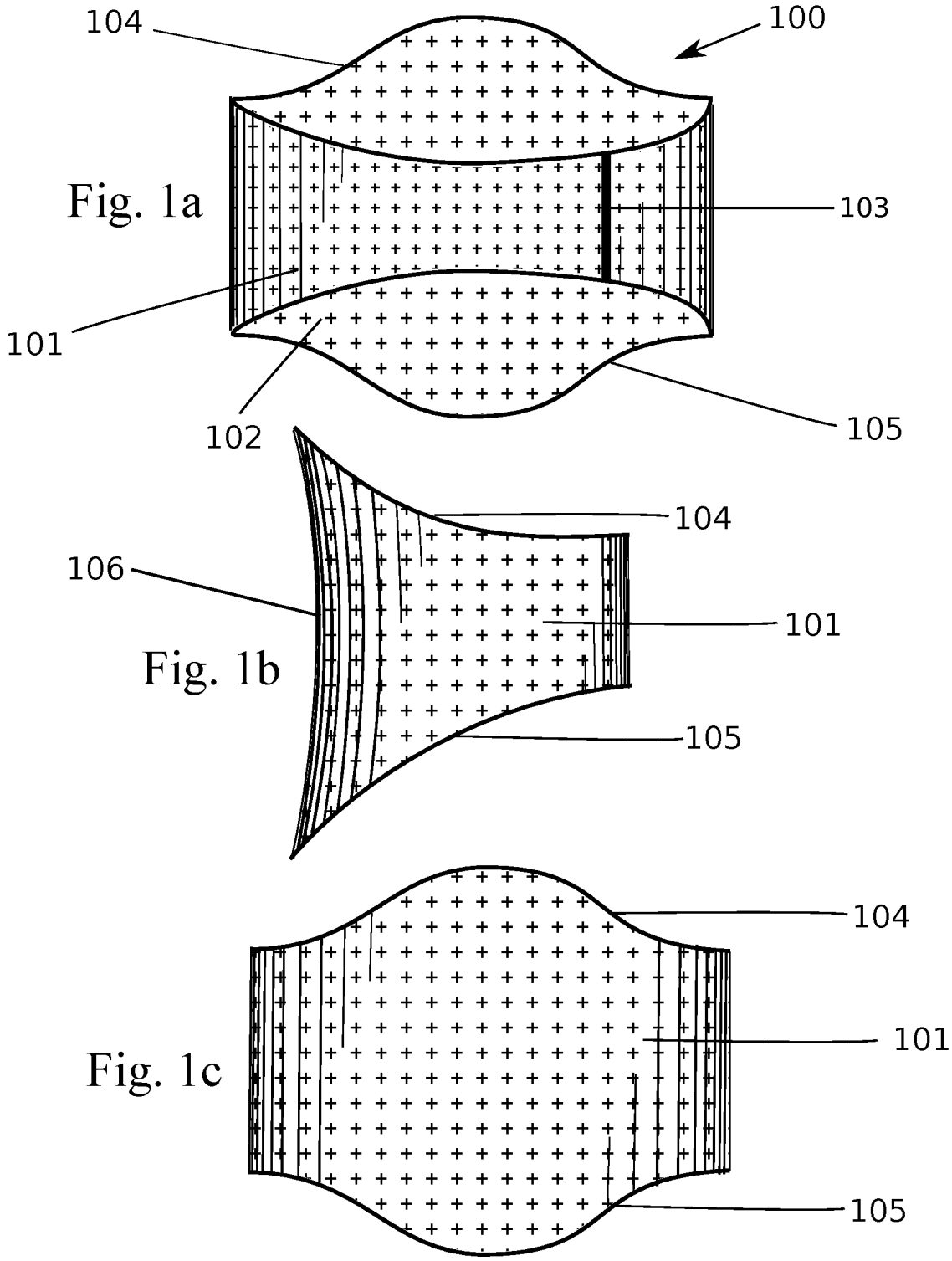
FIG. 1*a* is a front view of an embodiment of the invention positioned as it could be worn by a user, without a user visible.
FIG. 1*b* is a side profile view of an embodiment of the present invention as it could be worn by a user, without a user visible.
FIG. 1*c* is a rear view of an embodiment of the present invention as it could be worn by a user, without a user visible.

Components of the Invention:

FIG. 1*a* is, in this example, a front view of an embodiment of the apparatus by itself, as it would appear when worn by user. Number 101 represents a textured, high friction surface material on the outward-facing side of the apparatus. Number 102 represents a textured, high friction surface material on the inward-facing side of the apparatus. Number 103 represents the point of connection where low-profile attachments on either ends of the apparatus could meet to secure the ends together. In this embodiment, the attachments at the ends would keep the material from loosening after it has been pulled tight around the user's body. Number 104 represents a possible shape of cut for the material, on one side of the apparatus, to create a contour to allow the apparatus to better fit the user's body. Number 105 represents a possible shape of cut for the material on the opposite side of the apparatus, to create a contour to allow the apparatus to better fit the user's body. FIG. 1*b*, in this example, represents a side view of an embodiment of the apparatus. Number 106 represents the contour of the material as it is pressed or drawn tight against the user's body. In this example, drawing the material of the apparatus tight around the user would create material stretch in the apparatus and conform tightly to curves of the user's body. In this example, the attachments represented by 103 would hold the tension of the material stretch to keep the apparatus in shape of FIG. 1*b* around the user's body. FIG. 1*c*, in this example, represents a rear view of an embodiment of the present invention, where number 101 represents the outward-facing, textured, high friction surface material.

Figure 2A:
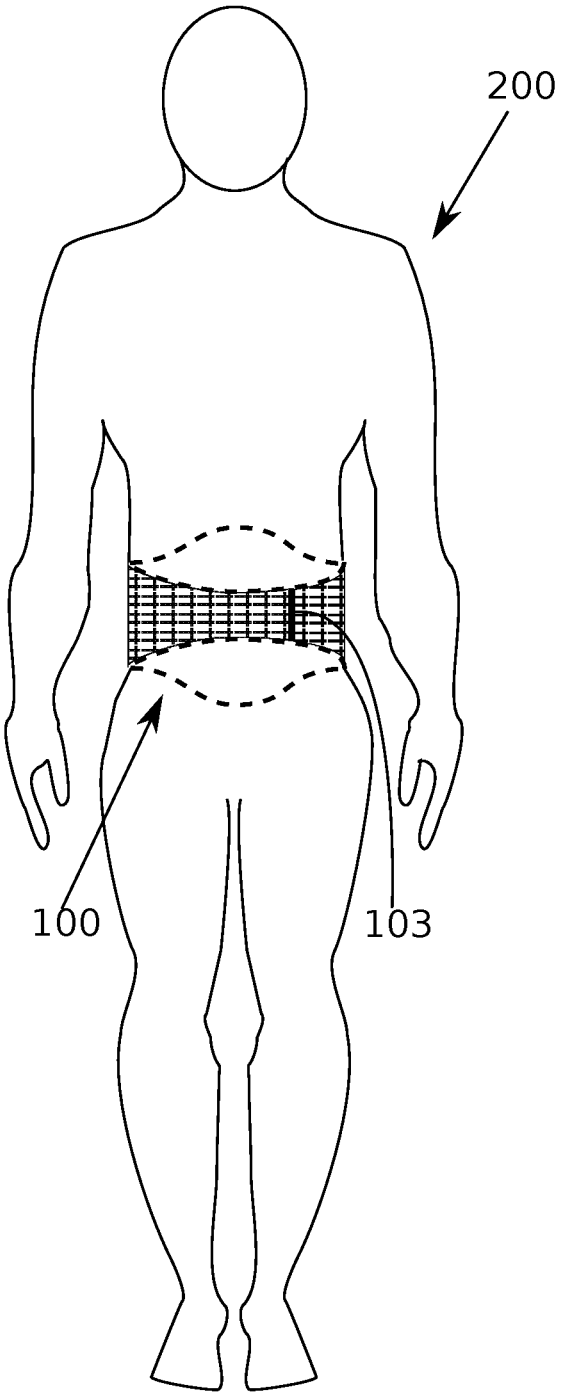
FIG. 2*a* is a front view of an embodiment of the present invention as it could be worn on the body of a human user.
Figure 2B:
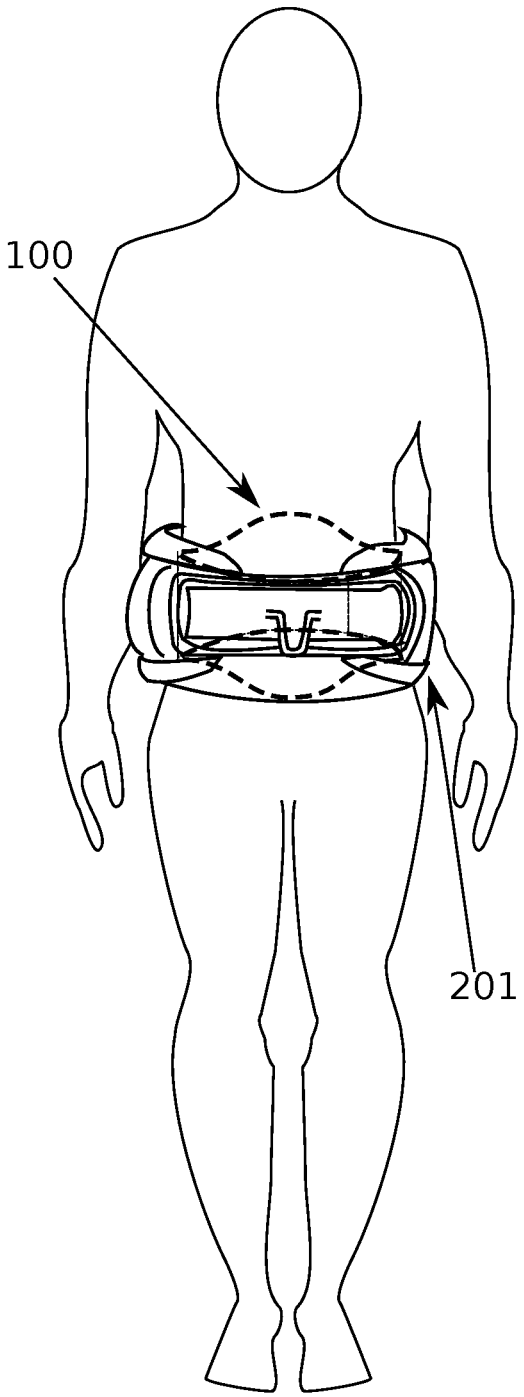
FIG. 2*b* is a front view of a kiteboard or windsurf "waist style" harness worn over an embodiment of the present invention, around the waist of a user.

FIG. 2*a*, in this example, represents the embodiment of the present invention, as illustrated in FIG. 1*a*, worn on the body of a user around the waist. The present invention may also be worn at other locations on the body, such as around the torso, or hips. Similar embodiments of the present invention may be worn at other locations on the body, such as a leg, where a harness or personal flotation device may contact the user's body. Number 201 in FIG. 2*b* represents a "waist style" kiteboard or windsurf harness worn over the embodiment of the invention represented in FIG. 2*a*. FIG. 2*b* 100 represents one embodiment of the present invention as it would be used between a user's body and an external harness device.

Figure 3A:
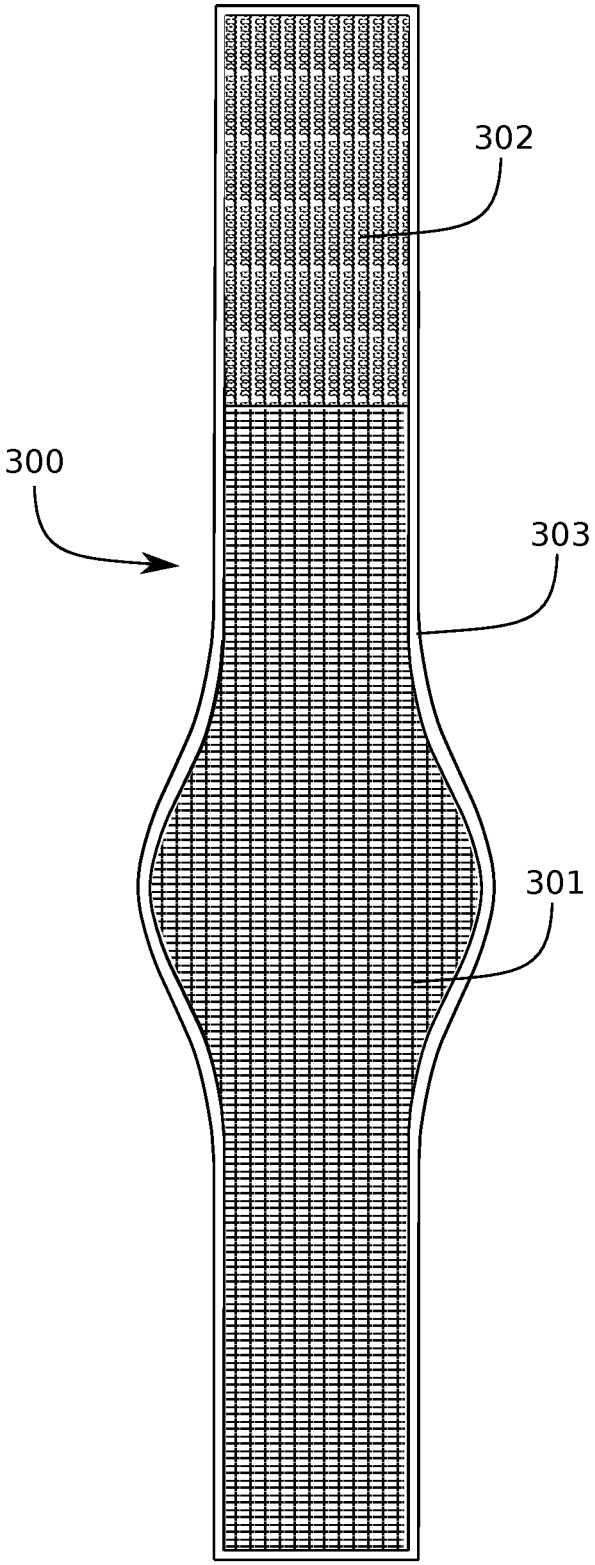
FIG. 3*a* is an elevation view of the outward-facing side of an embodiment of the present invention as it would appear laid flat, unadorned by a user.
Figure 3B:
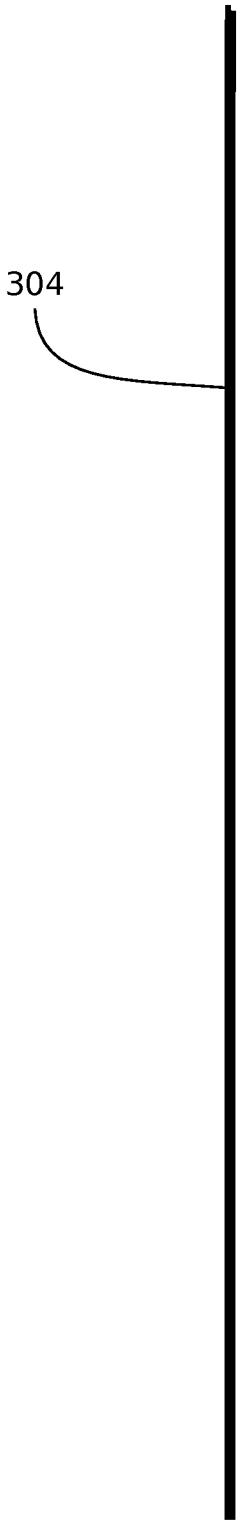
FIG. 3*b* is a profile view of the length of an embodiment of the present invention as it would appear laid flat, unadorned by a user.

FIG. 3*a*, in this example, represents the embodiment of the present invention of FIG. 1*a*, as it would appear laid flat, unadorned by a user. Number 301 represents a view of the outward-facing textured high friction surface material of number 101 as it would appear when the device is laid flat. Number 303 represents a possible nylon or polyester edging material affixed around the outer perimeter of the present invention. Number 302 represents an outward-facing section of "Velcro" style loop material that would give a range of attachment surface locations for placement of the opposing, inward-facing, hook attachment represented in FIG. 4*a* number 402. FIG. 3*b* number 304, in this example, represents a profile view of the length of the present invention represented in FIG. 3*a*. In FIG. 3*b*, in this example, the present invention can be seen as a long thin section of material.

Figure 4A:
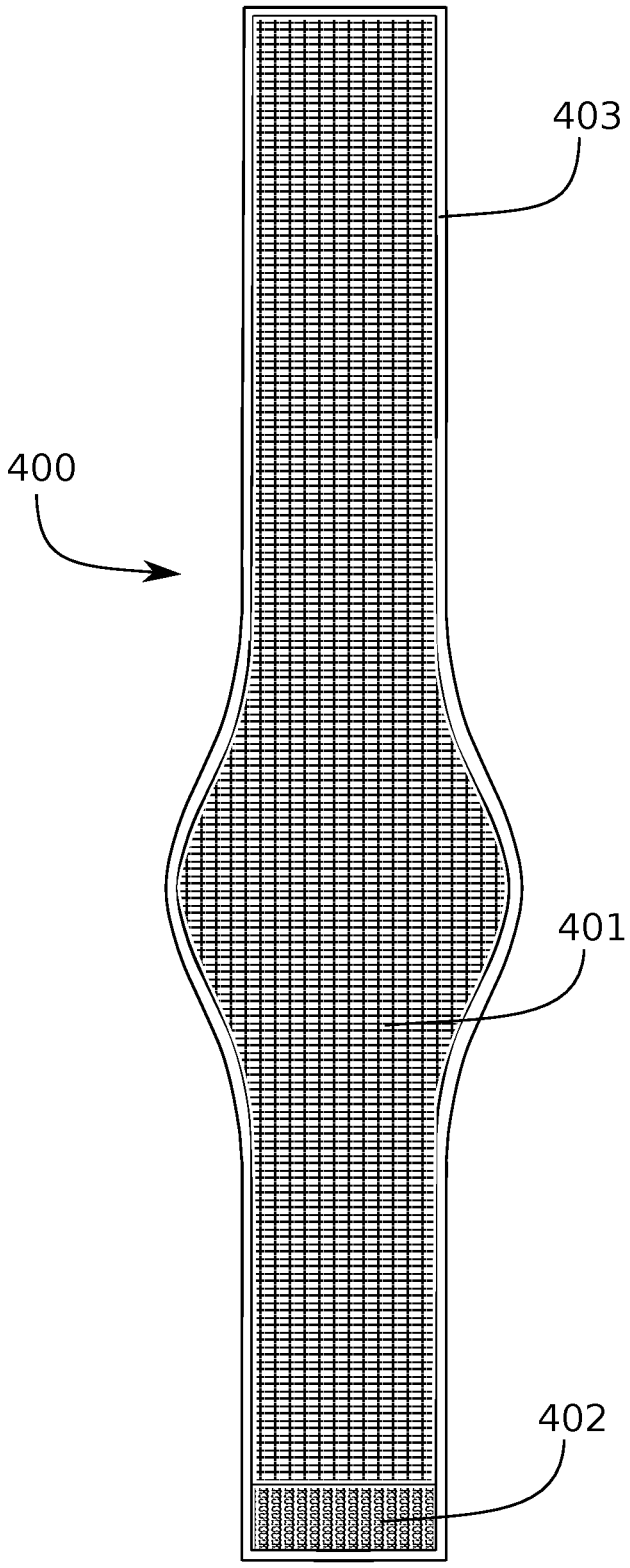
FIG. 4*a* is an elevation view of the inward-facing side of an embodiment of the present invention as it would appear laid flat, unadorned by a user.
Figure 4B:
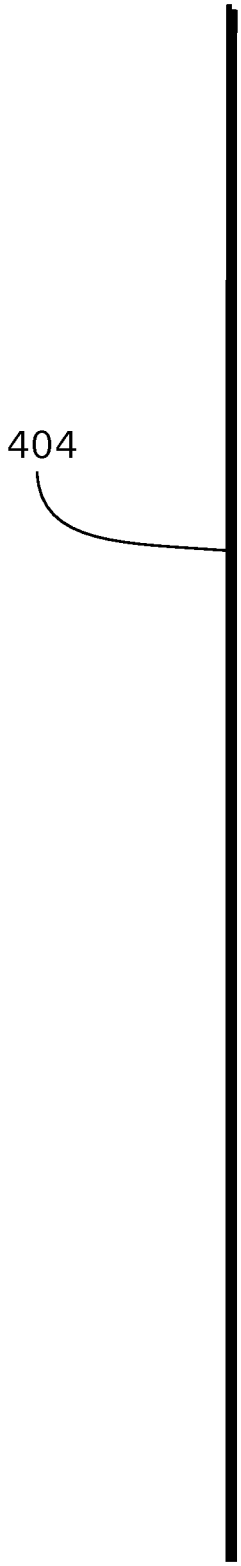
FIG. 4*b* is a profile view of the length of an embodiment of the present invention as it would appear laid flat, unadorned by a user.

In FIG. 4*a*, in this example, number 401 represents the inward-facing surface of the embodiment of the present invention of FIG. 1*a*, as it would appear laid flat, unadorned by a user. Number 402 represents the "Velcro" style hook that could attach to various positions on the opposing loop surface of number 302.

Figure 5A:
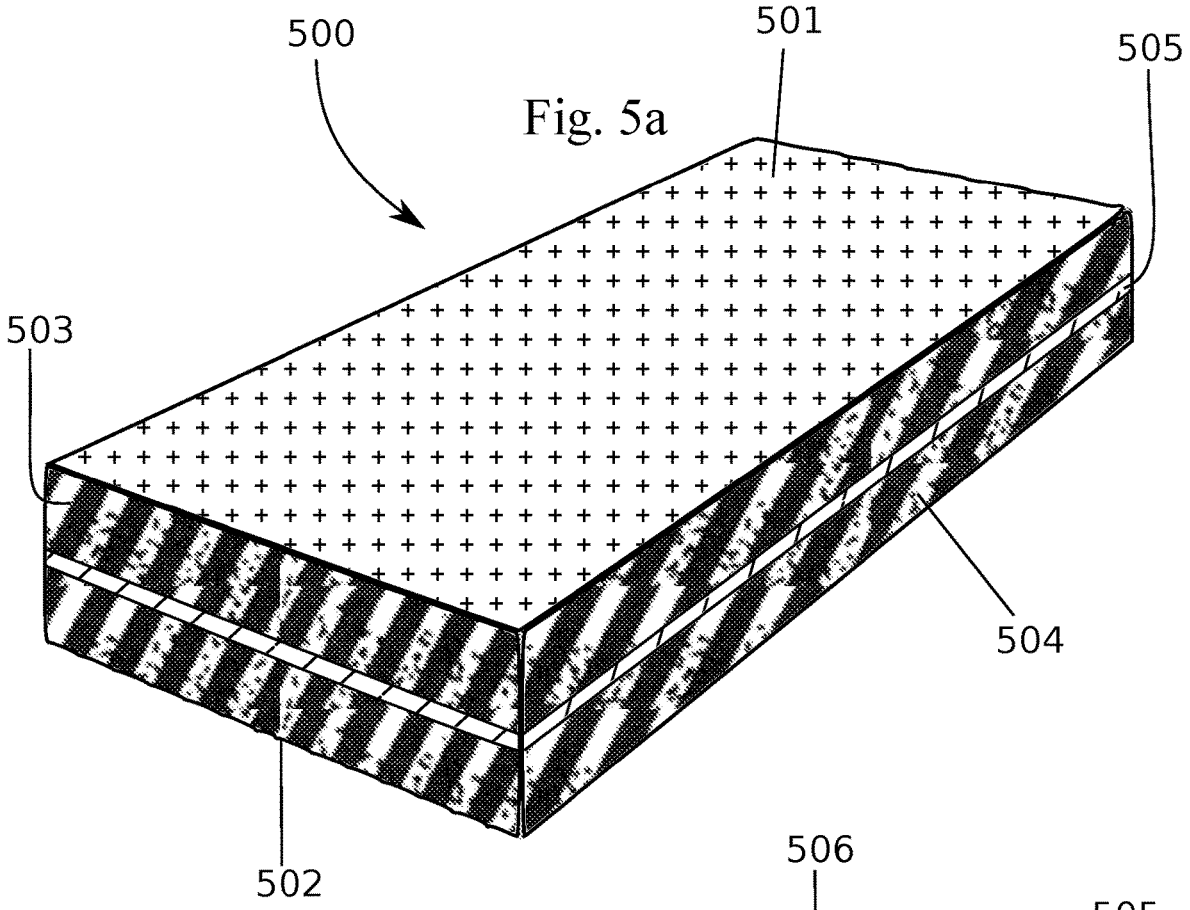
FIG. 5*a* is an askew cross section view of material assembly for an embodiment of the present invention.
Figure 5B:
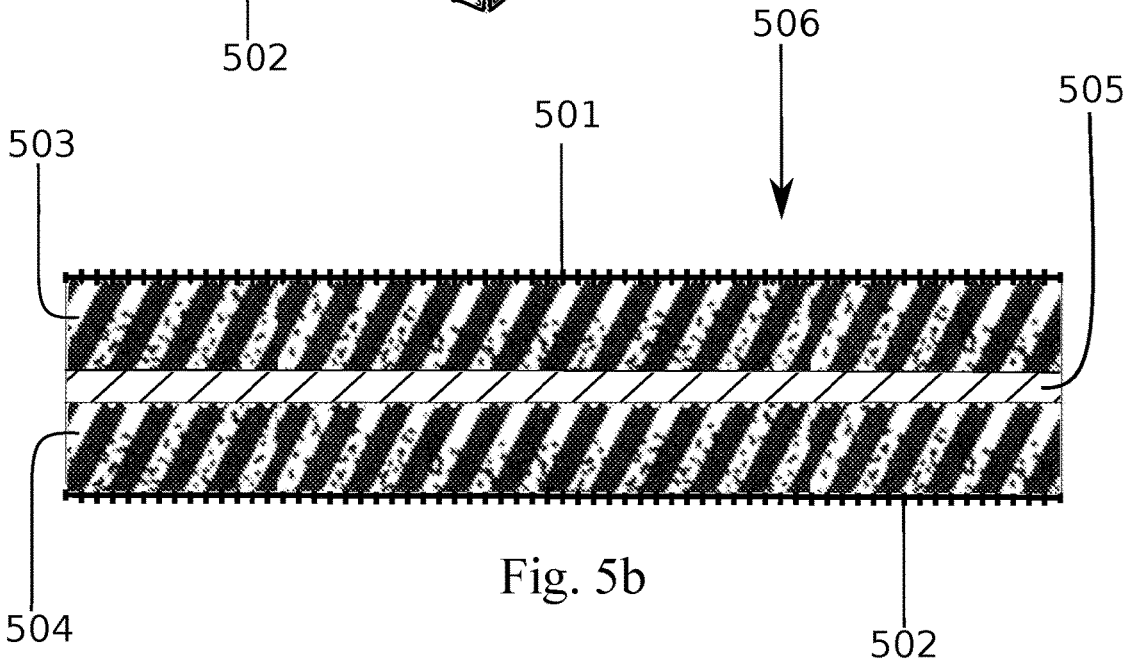
FIG. 5*b* is a cross section view of material assembly for an embodiment of the present invention.

In FIG. 5*a* number 500, in this example, represents an askew view of a possible cross section of material construction for the present invention. Number 501 represents the textured high friction surface material represented in FIG. 1*a* number 101. On the opposite side of the material, number 502 represents the textured high friction surface material represented in FIG. 1*a* number 102. In this embodiment of the present invention both the inward-facing surface number 102, and the outward-facing surface number 101 could be made of the same material. In this example, the embodiment of the present invention could use a "shark skin" style neoprene (chloroprene rubber) in which the surface is patterned and molded from the underlying neoprene rubber material. The underlying neoprene rubber material, in this example, is represented by number 503 and number 504. In other embodiments, number 501 and/or 502 could represent an applied embossment or high friction fabric type material that could be affixed to the underlying layers represented by number 502 and number 503. Other surface textures may work in additional embodiments. In between the neoprene rubber layers, in this example, represented by 503 and 504, could be a thin layer of stretchable material, represented by number 505, such as polyester, elastane, or nylon, to provide tensile strength at a certain stretch limit, to give tear resistance to the apparatus. FIG. 5*b*, in this example, is a side view of the cross-section FIG. 5*a*. In FIG. 5*b* number 501 can be seen to have a textured surface.

The important factors in the design of the present invention are that the surface of the material have innately, or be made to have a high surface friction, possibly similar to USPTO Class 2 Apparel 161.3 or Class 2 Apparel 168, and that the material have some amount of stretch and pressure absorption. In one embodiment, the device may be made from a material that stretches and conforms to the user's body, such as a textured surface chloroprene rubber (neoprene) on both the inward-facing side in contact with the user's body or garments, and on the outward-facing side in contact with the harness or personal flotation device. In one embodiment, the neoprene may be three to four millimeters in thickness. Thickness of the pad apparatus could vary depending on the level of stretch and pressure absorption desired. In another embodiments, additional materials may be used for the body of the apparatus.

In one embodiment, the open front ends of the present invention may be secured together, enclosing the pad around the user's body, by using a low-profile attachment device such as "Velcro" style hook and loop attachments on either side of the device ends.

Hook and loop attachments may provide repeated fastening of the attachments. In one embodiment, the edges of the present invention are covered with a nylon or polyester material or similar with material stretch properties. In one embodiment, the present invention is designed to be wider at the midpoint for a contoured fit to the user's body, and tapers to become narrower at the ends near the attachment points.

Process for Building the Invention:

Cutting the material may be done with a razor, or scissors, or a die cut machine, or other mechanism. In one embodiment, materials are glued together using an adhesive appropriate for neoprene or nylon, or sewn together. In one embodiment, one of the open ends of the device has "Velcro" style loops on the outside of the device facing away from the user glued or sewn in place. The opposite end of the device has "Velcro" style hooks glued or sewn in place on the inside of the device facing the loops of the opposing side so that the two sides meet and join together through hook and loop attachment properties. Alternate embodiments may use different means of attaching the ends. The edges of the pad device may be covered with a nylon or polyester material that is glued on with an appropriate adhesive, or sewn on.

It will be apparent to one with skill in the art that the traction pad apparatus may be provided using some or all of the mentioned features and components without departing from the spirit and scope of the present invention. It will also be apparent to the skilled artisan that the embodiments described above are specific examples of a single broader invention which may have a greater scope than any of the singular description taught. There may be many alterations made in the descriptions without departing from the spirit and scope of the present invention.

The invention claimed is:

1. A body pad that is configured to be stretched around a waist of a kiteboarder or windsurfer without tearing and that, thereafter, cushions forces applied to the waist by a kiteboarding or windsurfing harness that is worn around the body pad and reduces slippage between the harness and the waist during kiteboarding or windsurfing, the body pad comprising:

a stretchable material having an interior layer, a central layer, and an exterior layer that are all coextensive with one another, wherein:

the interior layer is thick and compressible, has an exterior surface attached to an interior surface of the central layer, and has an interior surface that has a high surface friction;

the exterior layer is thick and compressible, has an interior surface attached to an exterior surface of the central layer, and has an exterior surface that has a high surface friction; and the central layer is a fabric that is thinner than each of the interior layer and the exterior layer and that has a tensile strength and tear resistance that are both greater than that of the interior and exterior layers, thereby protecting the interior and exterior layers from being torn during use of the harness; and a low-profile connector at opposing ends of the stretchable material that reversibly binds the opposing ends to one another.

2. The body pad of claim 1 wherein the interior and exterior layers are made of foam rubber.

3. The body pad of claim 1 wherein the central layer is made of polyester, elastane or nylon.

4. The body pad of claim 3 wherein the interior and exterior layers are made of foam rubber.

5. The body pad of claim 1 wherein the interior and exterior layers have a combined thickness of at least three millimeters.

6. The body pad of claim 5 wherein the interior and exterior layers have a combined thickness of no more than four millimeters.

7. The body pad of claim 1 wherein the low-profile connector includes hooks attached near one end of the opposing ends of the body pad and loops attached near the opposite end of the opposing ends of the body pad.

8. The body pad of claim 1 wherein the low-profile connector is adjustable enabling the circumference of the body pad to be adjusted when the opposing ends are reversibly attached so that the body pad can completely and snugly fit around round body parts of different sizes, all without tearing.

9. The body pad of claim 1 wherein the body pad has a width that continuously varies from widest along one side of the body pad to narrowest along an opposite side of the body pad.

10. The body pad of claim 1 wherein the body pad has an outer perimeter and further comprises edging material around the outer perimeter.

11. A method for filling gaps and reducing slippage between a kiteboarding or windsurfing waist harness and a waist of a human around which the waist harness is worn and for cushioning unequal pressures applied by the waist harness to the waist while the waist harness asserts forces to the waist during kiteboarding or windsurfing, the method comprising:

stretching the body pad of claim 1 completely but snugly around the waist;

placing the waist harness around the waist and the stretched body pad; and using the waist harness during kiteboarding or windsurfing.

* * * * *